United States Patent [19]

Gerwick, Jr.

[11] 4,045,968

[45] Sept. 6, 1977

[54] OFFSHORE PLATFORM AND METHOD FOR ITS INSTALLATION

[75] Inventor: Benjamin C. Gerwick, Jr., Oakland, Calif.

[73] Assignee: Kajima Corporation, Tokyo, Japan

[21] Appl. No.: 644,017

[22] Filed: Dec. 24, 1975

[30] Foreign Application Priority Data

Dec. 24, 1974 Japan ..... 49-147594

[51] Int. Cl.[2] ..... E02B 17/00; E02D 5/00

[52] U.S. Cl. ..... 61/86; 61/50; 61/93; 61/98; 52/167; 248/357

[58] Field of Search ..... 61/46.5, 46, 50, 86, 61/87, 93, 95, 98; 248/357; 52/167

[56] References Cited

U.S. PATENT DOCUMENTS

| | | | |
|---|---|---|---|
| 2,895,301 | 7/1959 | Casagrande et al. | 61/46.5 |
| 3,738,113 | 6/1973 | Madary et al. | 61/46.5 |
| 3,896,628 | 7/1975 | Hansen | 61/46.5 |
| 3,911,687 | 10/1975 | Mo | 61/46.5 |
| 3,945,212 | 3/1976 | Mo | 61/46.5 |

*Primary Examiner*—Jacob Shapiro

*Attorney, Agent, or Firm*—Beveridge, DeGrandi, Kline & Lunsford

[57] ABSTRACT

A platform and method are suited for use in connection with offshore drilling in earthquake-vulnerable areas where the sea floor is soft. Caissons project downwardly from the base raft into the sea floor layer, thereby giving the platform a resistance to horizontal forces. The caissons are connected to the platform by energy absorbing means which yield to permit relative movement when subjected to earthquake-produced forces.

12 Claims, 6 Drawing Figures

OFFSHORE PLATFORM AND METHOD FOR ITS INSTALLATION

BACKGROUND OF THE INVENTION

This invention relates to concrete platforms of the type used for offshore drilling or similar work and, in particular, is concerned with a platform structure and a method for erecting it in areas where there is a weak or soft sea floor layer as is encountered in regions of high earthquake activity.

It is generally acknowledged that concrete platforms are superior to conventional steel platforms in terms of safety and economy in sites where the depth of water is greater and environmental conditions are severe. Such concrete platforms have been developed for practical use and are employed in drilling work for petroleum and natural gas in offshore installations. The nature of concrete platforms is described in my earlier U.S. patents which are incorporated herein by reference.

Concrete platforms must be capable of sustaining horizontal forces imposed upon them by wave action, tides, currents and the like. A conventional gravity type concrete platform withstands such horizontal forces by friction between its base and the sea floor. To withstand greater horizontal forces, this friction has been increased by increasing the in-water weight of the platform and this, in turn, increases the load on the sea floor, requiring the sea floor layer to possess greater supporting strength. Such increased supporting strength cannot be provided by the relatively soft or weak sea floors of the littoral seas around Japan and elsewhere.

Prominent external horizontal forces are those produced by earthquakes. These forces can be several times as great as the maximum horizontal forces imposed by sea waves. For this reason, it is desirable in a relatively lightweight platform constructed according to this invention, to disjoin structurally the caissons from the superstructure above said caissons to permit relative horizontal displacement between the caissons and the remainder of the platform during an earthquake, thereby minimizing response acceleration of the superstructure and reducing the active forces on the platform structure.

SUMMARY OF THE INVENTION

This invention involves the structure and installation method of a concrete platform suitable for use in areas of weak sea floors and/or regions of earthquake activity.

The platform of the invention is similar to gravity-type platforms in the sense that it has an upper deck, towers supporting the deck, and a base assembly which includes caissons. However, the in-water weight is low to avoid the imposition of excessive loads on the sea floor layer. The invention comprises several aspects which either singly or jointly contribute to the utility of this novel system. According to one aspect of the invention, the caissons are sunken into the sea floor layer so that the caissons will counter the external horizontal forces encountered in such an environment, the external horizontal forces being sustained and counteracted by the soil pressure acting laterally on the caissons rather than by frictional forces. Another aspect of the inventive structure is that the caissons are attached to the other elements of the platform by an energy absorbing means which permits relative movement between the caissons and the remainder of the platform in the event of earthquake-imposed horizontal forces. This feature minimizes response acceleration of the superstructure and reduces the active forces on the platform structure. Still another aspect of the invention is to insure against the adverse effects of earthquake-produced fluidization of the sea floor layer. This is achieved either by embedding the caissons below the maximum depth of fluidization or by providing means for pumping water from the sea floor layer in the area of the platform to such a maximum depth. The inventive methods correspond to these aspects and relate to the lowering of the caissons to their sunken position during installation, pumping water from the earthquake-fluidizible layer of the sea floor and the like.

DESCRIPTION OF THE DRAWINGS

FIG. 2 is an elevational view, partially in section, as seen along the line 2—2 in FIG. 3;

FIG. 3 is a plan view of a preferred installation, as seen along the section line 3—3 in FIG. 2.

FIG. 4 is a sectional view showing the relationship between the energy absorber, the caissons and the base raft as seen along the line 4—4 in FIG. 2.

FIG. 5 is a sectional view of the caisson, showing its honeycomb-like reinforcements in section as seen along the line 5—5 in FIG. 2.

DESCRIPTION OF A PREFERRED EMBODIMENT OF THE INVENTION

Figure 1A:
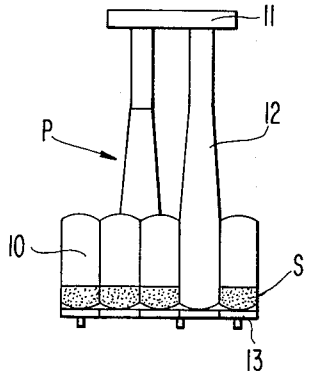
FIG 1a (PRIOR ART)
FIGS. 1*a* and 1*b* are, respectively, an elevational view and a plan view of a conventional prior gravity-type concrete platform.
Figure 1B:
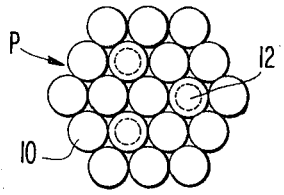
FIG 1b (PRIOR ART)

An example of a conventional concrete platform, known as a gravity type platform, is illustrated in FIGS. 1*a* and 1*b* which show a platform P formed of caissons 10, deck 11, tower 12 for supporting the deck, and a steel skirt 13 below the caissons. The caissons 10 serve both to create buoyancy which is required when the platform P is floated for towing to the installation site, and to retain a stabilizing ballast such as sand S which is admitted into the caisson after the platform P is located and set at the place of installation. the weight of the platform P and its ballast provide the stability needed to stand on the sea floor. The term "gravity-type" refers to this weight feature of conventional concrete platforms.

Such gravity-type concrete platforms are well-suited for installation on hard sea floor layers capable of supporting platforms of great weight. Conversely, such platforms are not suitable for soft or weak floor layers, particularly in regions where earthquakes occur frequently. For example, most of the littoral seas surrounding Japan are recognized as earthquake regions and, moreover, the floor layers of these seas are generally so soft or weak that it is practically impossible to insure standing stability of a gravity type concrete platform.

A preferred embodiment of the invention is shown in FIGS. 2–5, wherein the concrete platform is provided with three concrete caissons 1*a*, 1*b* 1*c*, three towers 3*a*, 3*b* and 3*c* which support the above-water deck 2, and a base raft 4. The horizontal crossectional areas of the towers 3*a*, 3*b* and 3*c* diminish in an upward direction to reduce the sea effects on the upper part of each tower.

The base raft 4 surrounds and is rigidly connected to the lower bulky parts of the towers so that the three towers act as an integral structural unit. The base raft has reinforced horizontally extending flanges which extend laterally beyond the caissons for resting on the sea floor surface. The downwardly facing surface area of the base raft 4 is greater than that of the embedded caissons 1*a*, 1*b* and 1*c*.

When the platform is transferred to the site of installation, the caissons 1*a*, 1*b*, 1*c* and towers 3*a*, 3*b*, 3*c* are filled with air to serve as buoyant vessels. Upon arrival at the installation site, the platform is sunk to the sea floor by placing sand ballast in the caissons and by the use of a known high pressure jet air lift system, not shown. As the platform descends, the caissons are lowered into the sea floor layer beneath the sea floor surface until the flanges of the base raft 4 are brought against the sea floor surface. The ballast imparts some standing stability to the platform after it is set in place, but it is preferred that portions of the towers or caissons remain filled with air thus creating a permanent buoyancy which minimizes the effective weight of the platform on the sea floor.

Figure 2:
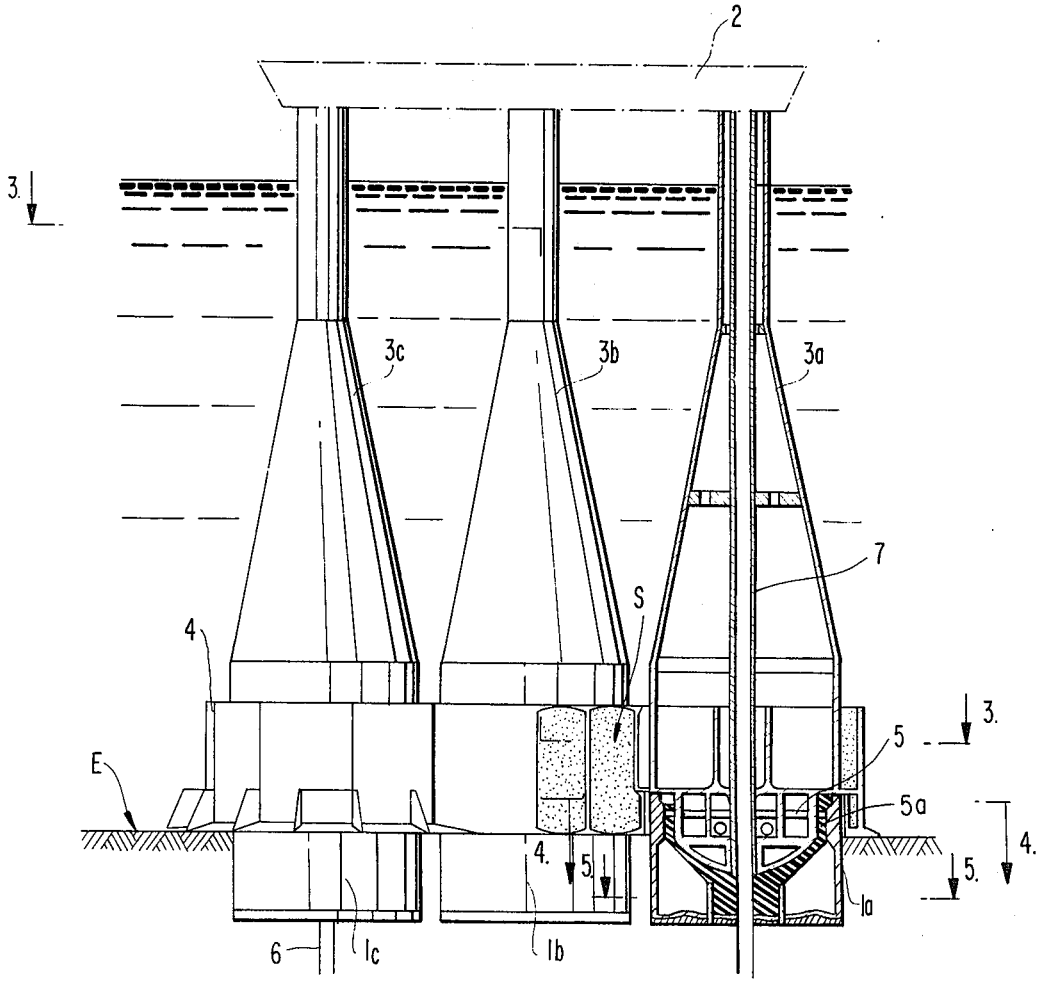
FIGS. 2–5 illustrate a preferred embodiment of the invention.
Figure 3:
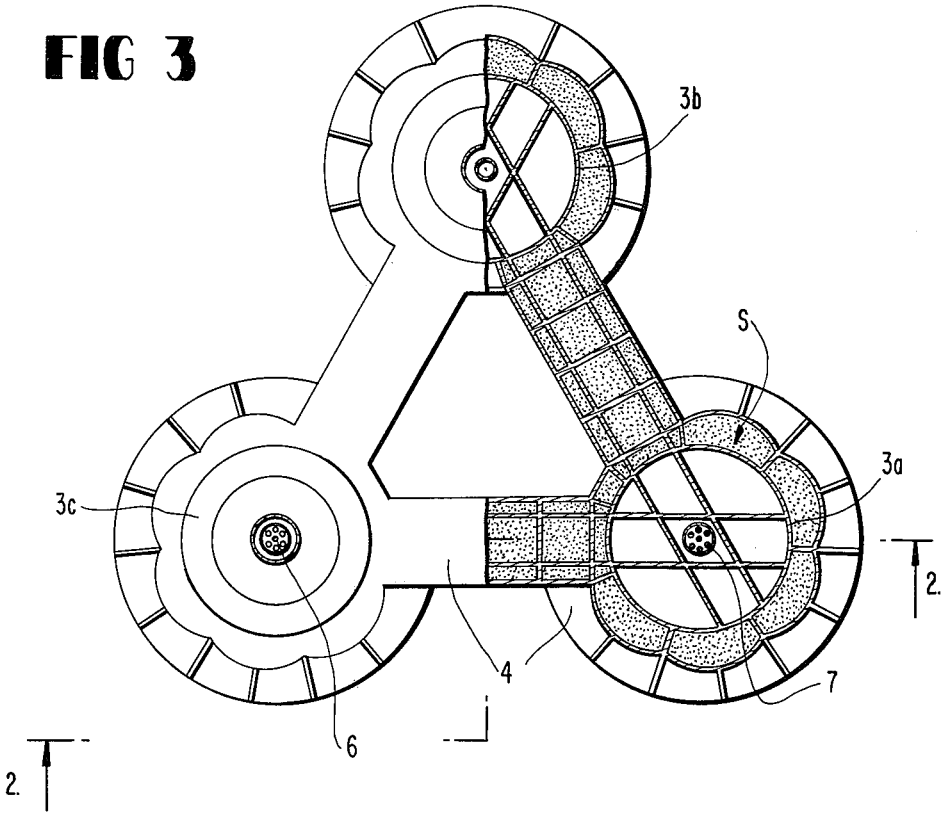
Figure 4:
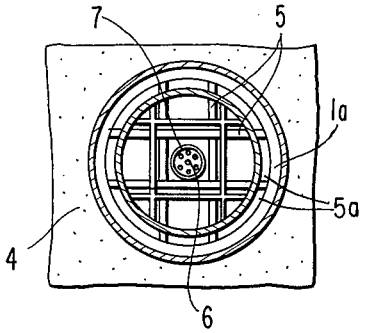
Figure 5:
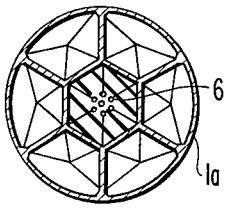

The caissons 1*a*, 1*b* and 1*c* are substantially immovable with respect to the base raft 4 when the platform is subjected to horizontal loads equal to maximum sea wave force, but their interconnection is not rigid enough to resist relative displacement when subjected to the greater horizontal loads imposed by an earthquake or a severe storm. This selective response to external horizontal forces is made possible by the presence of a dual energy absorber means 5 which interconnects the base raft 4 with caissons 1*a*, 1*b* and 1*c* as illustrated in FIGS. 2 and 4. In these drawings, it will be noted that the cylindrical lower ends of the towers 3*a*, 3*b* and 3*c* are concentrically positioned within the cylindrical sections of the respective caissons 1*a*, 1*b* and 1*c* so that these elements are interfitted in the horizontal plane represented by the section line 4—4. The energy absorber 5, consists of a rigid attachment which fails by shear, or by buckling or other means under large forces, and an absorbing medium such as rubber or a viscous or constrained fluid which extends between or is affixed to both of these cylindrical bodies to absorb any energy produced by their relative movement.

A plurality of conductor pipes 6 surrounded by a tubular casing 7 are arranged and constructed to accommodate any earthquake-produced relative displacement between the base raft 4 and the caissons 1*a*, 1*b* and 1*c*. The raft 4 and caissons 1*a*, 1*b* and 1*c* are structurally correlated so that their maximum allowable relative displacement under earthquake conditions will be equal to or greater than the maximum horizontal displacement of the sea floor occuring in an earthquake.

It is believed that soft sea floor layers (usually located in a sandy stratum, rather loose in composition) are fluidized by liquefaction to a certain depth below the sea bottom when earthquake occurs. This causes the layer to behave somewhat like a liquid, thus destroying its ability to support a gravity type platform.

To prevent fluidization of the sea floor layer around the platform, two measures are proposed. The first measure involves the lowering of the caissons to a depth of at least about 20 meters below the sea floor surface, which is below the depth where fluidizing will occur during the most severe earthquake. Alternatively, a plurality of draining wells may be provided in association with each caisson, these wells operating to remove water from the sea floor layer extending to the depth mentioned above in this paragraph. The continuous draining by pumping from these wells reduces the interstitial hydrostatic pressure in the sea bottom floor layer E around and under caissons 1*a*, 1*b*, and 1*c* to minimize the tendency of layer E to be fluidized upon occurrence of an earthquake.

The preferred mode of this invention having thus been described, it will be apparent to those skilled in the art that the concrete platform described herein is capable of serving as a safe and stable platform when it is installed on a soft or weak sea floor, suitably but not essentially in a region of high earthquake activity as in the littoral seas around Japan. Inasmuch as the invention is susceptible to innumerable modifications, revisions and improvements, it is emphasized that the scope of the invention is not limited to the preferred embodiments but is prescribed by the claims which follow.

This application hereby incorporates by reference the entire subject matter of a paper OTC 2408 prepared by me for the Seventh Annual Offshore Technology Conference, May, 1975. Copies of this paper are available from Offshore Technology Conference, 6200 North Central Expressway, Dallas, Tex. 75206.

I claim:

1. A concrete platform for use in offshore drilling and the like, comprising a superstructure and a base structure, said superstructure including a deck and supporting towers, said base structure including a base raft and caissons, said caissons extending downwardly from the base raft to be embedded in the soil of the sea floor layer whereby external horizontal forces acting on the platform are opposed by soil pressure acting laterally on the sunken portions of the caissons, energy absorbing means interconnecting said caissons and said base raft, said energy absorbing means including (a) members which are relatively rigid under wave forces but which fail under strong earthquake and (b) an energy-absorbing resilient (elastic) material.

2. The concrete platform of claim 1 wherein said caissons extend at least about 20 meters into the sea floor layer so as to lie below a depth at which the sea bottom layer is fluidized by liquefaction during an earthquake.

3. The concrete platform of claim 1 having wells extending therebeneath to a depth of at least 20 meters below the sea floor surface, means for pumping water from said wells to reduce the interstitial hydrostatic pressure within the sea floor layer and prevent fluidization by liquefaction of the sea floor layer in the event of an earthquake.

4. The concrete platform of claim 1 wherein said base raft has a downwardly facing surface extending laterally beyond said caissons for resting on the sea floor surface.

5. The concrete platform of claim 4 wherein the downwardly facing surface area of the base raft is greater than the downwardly facing area of the caissons.

6. The concrete platform of claim 1 having energy-absorbing means interconnecting said caissons and said base raft.

7. The concrete platform of claim 1 wherein a portion of said caisson and a portion of said base raft are interfitted in a given horizontal plane, said energy absorbing means lying in said given horizontal plane.

8. The concrete platform of claim 7 wherein said base raft has a downwardly facing surface extending laterally beyond said caissons for resting on the sea floor surface.

9. The concrete platform of claim 8 wherein said caissons extend at least about 20 meters into the sea floor layer so as to lie below a depth at which the sea bottom layer is fluidized by liquefaction during an earthquake.

10. A concrete platform for use in offshore drilling and the like, comprising a deck, supporting towers, a base raft, caissons and energy absorbing means for absorbing earthquake energy generated in the event of earthquake, said energy absorbing means holding said caissons stationary with respect to the platform until forces therebetween exceed a magnitude which occurs during an earthquake at which point the energy absorbing means allows a relative displacement between the caissons and the platform, said energy absorbing means including (a) members which are relatively rigid under wave forces but which fail under strong earthquake and (b) an energy-absorbing resilient (elastic) material.

11. The platform of claim 10 wherein said energy absorbing means interconnects said caissons and said base raft.

12. A concrete platform according to claim 10 wherein portions thereof include flotation chamber means for creating a permanent buoyancy to minimize the effective weight of the platform imposed on the sea bottom floor, whereby the platform is capable of being installed and erected on a soft or weak sea bottom layer.

* * * * *